US005251567A

United States Patent [19]

Fuwa

[11] Patent Number: 5,251,567

[45] Date of Patent: Oct. 12, 1993

[54] STENCIL MAKING DEVICE HAVING MEANS FOR CONTROLLING DOT PERFORATION DENSITY

[75] Inventor: Tetsuji Fuwa, Hashima, Japan

[73] Assignee: Brother Kogyo Kabushiki Kaisha, Nagoya, Japan

[21] Appl. No.: 888,864

[22] Filed: May 27, 1992

[30] Foreign Application Priority Data

Jun. 6, 1991 [JP] Japan ..... 3-134937

[51] Int. Cl.[5] ..... B41C 1/14

[52] U.S. Cl. ..... 101/128.4; 101/129

[58] Field of Search ..... 101/128.21, 128.4, 121, 101/122, 125, 129; 400/136

[56] References Cited

U.S. PATENT DOCUMENTS

| | | | |
|---|---|---|---|
| 2,499,472 | 3/1950 | Dyal | 101/121 |
| 3,541,956 | 11/1970 | Falchero | 101/121 X |
| 3,799,053 | 3/1974 | Rabelow | 101/125 |
| 4,444,808 | 4/1984 | Kikuchi et al. | 101/128.21 X |
| 4,957,378 | 9/1990 | Shima | 400/136 X |

FOREIGN PATENT DOCUMENTS

| | | | |
|---|---|---|---|
| 0130612 | 1/1985 | European Pat. Off. . | |
| 54-9523 | 4/1979 | Japan . | |
| 0229560 | 10/1986 | Japan | 101/128.4 |
| 63-17074 | 1/1988 | Japan . | |
| 2032215A | 4/1980 | United Kingdom . | |

*Primary Examiner*—Edgar S. Burr
*Assistant Examiner*—Ren Yan
*Attorney, Agent, or Firm*—Oliff & Berridge

[57] ABSTRACT

A stencil making device capable of controlling numbers of perforations formed by a thermal head. A perforated image is formed by the thermal head in a heat sensitive stencil sheet. An ink in an ink pad passes through the perforated image for providing an inked image on a print sheet. If perforations are densely formed, excessive ink may pass through the perforations. Therefore, the numbers of the perforations are controlled or reduced at a thick character portion. A control unit is provided for changing ON dot area to the OFF dot area of the thermal head if the ON dot area are densely provided.

10 Claims, 11 Drawing Sheets

| | | |
|---|---|---|
| a | b | c |
| d | e | f |
| g | h | i |

STENCIL MAKING DEVICE HAVING MEANS FOR CONTROLLING DOT PERFORATION DENSITY

BACKGROUND OF THE INVENTION

The present invention relates to a portable stencil making device, and more particularly, to such device employing a stencil sheet perforatable by irradiation of infrared rays or by a thermal head and having means for controlling dot perforation density with respect to the stencil sheet.

Conventionally, has been known a small sized portable stencil making device employing a stencil sheet perforated by a stencil pen or a ball point pen to form a perforated image. One such conventional stencil making device is described in a Japanese Patent Application (Kokoku) No. 54-9523 as shown in FIG. 1. The stencil making device includes a table 100 and an ink applicator unit 102. The ink applicator unit 102 reciprocably supports the stencil sheet 104 to perform mimeographic printing at one extreme or protruded position, and is rested in another extreme or retracted position.

Further, has been known a conventional heat sensitive stencil sheet perforatable by infrared rays or a thermal head. One typical example of such sheet includes a thermoplastic resin film and a porous thin substrate adhered thereto by an adhesive agent. One conventional example of a stencil making device employing such heat sensitive stencil sheet is described in a Japanese Patent Application Kokai (OPI) No. 63-17074 as shown in FIG. 2. According to the conventional device, a stencil sheet 106 has a perforated heat sensitive stencil paper 110 and an ink impermeable cover sheet 112 superposed with each other and bonded to a frame 108. An ink is retained between the heat sensitive stencil paper 110 and the cover sheet 112. Further, The stencil sheet 106 retaining therein the ink is affixed to a stand 114 provided with a grip member 120 and having a cushion layer 116 and an adhesive layer 118. By pressing the grip member 120 against a print sheet, mimeographic printing is achieved through the stencil sheet 110.

However, as shown in FIG. 3, a perforation 51 will provide an ink enlarging area 52 spreading from the perforation 51. In case of the former type of the stencil making device, if large pressure is applied, a large volume of ink may pass through the heat sensitive stencil sheet 110 at an area where perforations are highly densely formed. Therefore, large volume of ink reaches the print sheet. As a result, it takes a long period for drying the thus transferred ink corresponding to that area, and the ink may further spread to blur an inked image.

If a shadow character H is to be printed as shown in FIG. 4, portions C and D are shown as enlarged views in FIGS. 5(*a*) and 5(*b*) in which 4×4 ON dots patterns are shown for comparison. As is apparent from these FIGURES, the portion D provides larger ink superposing portions than the portion C. That is, in the portion D, there are 4 (four) single ink portion, 12 (twelve) double piled ink portions, and 9 (nine) four-piled ink portions. In other words, there are many ink overlapping portions.

With such an arrangement, it takes a long time for drying the deposited ink, and therefore, long period is required for finishing a print, and moreover, ink blurring may occur. Further, operator's hand may be contaminated with the excessive ink prior to the ink drying, and non-printed area may also be contaminated by the undried ink.

SUMMARY OF THE INVENTION

The present invention is established in an attempt to overcome the above described problems, and it is an object of the present invention to provide a small sized portable stencil making device capable of controlling formation numbers of perforations (to control numbers of ON doted portions) so as to prevent a large volume of ink from passing through a region where the perforations are densely formed.

This and other objects of the present invention will be attained by providing a stencil making device for transferring an ink through a perforated image formed in a heat sensitive stencil sheet to form an inked image corresonding to the stencil sheet being formed of a thermoplastic film and a porous support bonded thereto, the stencil making device comprising, (a) feeding means for feeding the heat sensitive stencil sheet, (b) a thermal head for forming perforations to form the perforated image on the thermoplastic film of the stencil sheet, the perforations being formed at ON dot portions of the thermal head, (c) an ink pad disposed in confronting relation to the porous support of the heat sensitive stencil sheet, the ink pad impregnating therein an ink, and (d) control means for controlling numbers of perforations depending on crowdedness of the ON dots portion.

In the stencil making device of the present invention the thus constructed, the perforations are formed by a thermal head in the heat sensitive stencil sheet. In a region where the perforations are to be formed densely, thinning is performed in a perforation control for thinning perforation dots in order to suppress ink transmission through the region. As a result, ink drying can promptly be achieved while reducing ink blurring in a final inked image.

DETAILED DESCRIPTION OF THE PREFERRED EMBODIMENTS

A stencil making device according to one embodiment of the present invention will be described with reference to FIGS. 6 through 17.

Figure 6:
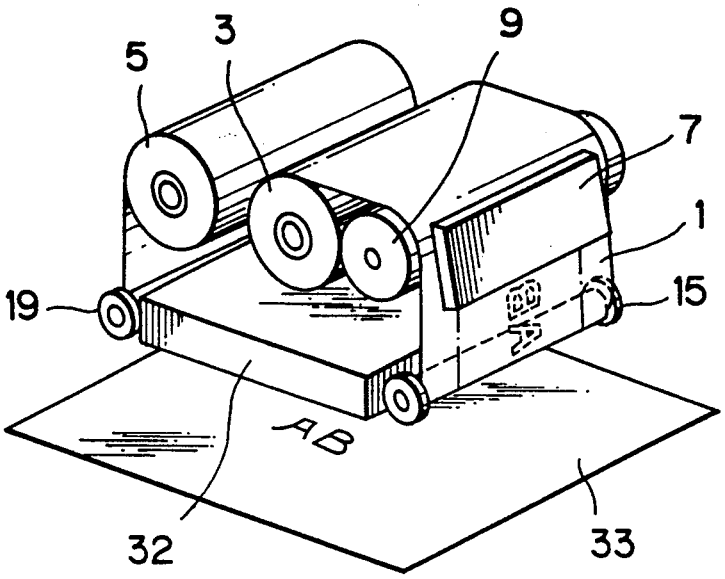
FIG. 6 is a perspective view showing a stencil making device according to one embodiment of this invention.
Figure 7:
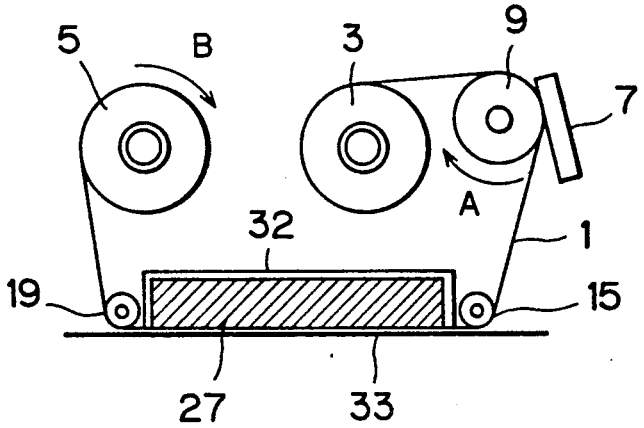
FIG. 7 is a schematic cross-sectional view showing the stencil making device according to the embodiment of this invention.

A general arrangement of a stencil making device according to the present invention is shown in FIGS. 6 and 7. Both ends of the heat sensitive stencil sheet (hereinafter simply referred to as "stencil sheet") 1 are wound over a supply roll 3 and a takeup roll 5.

A thermal head 7 is disposed at a position adjacent the supply roll 3, and a platen 9 is positioned in confronting relation to the thermal head 7. The thermal head 7 includes heat generating elements (not shown) capable of providing a plurality of, for example, 48 dot perforations in the stencil sheet 1 if all heat generating elements are rendered ON.

A pair of guide rollers 15 and 19 are rotatably provided for guiding travel of the stencil sheet 1. Each of the guide rollers 15 and 19 is provided with a pair of flanges whose distance correspond to a width of the stencil sheet 1 so as to avoid meandering travel thereof. Further, an ink pad 32 is positioned between the guide rollers 15 and 19 in such a manner that an ink application surface of the pad 32 is in facing contact with a print sheet 33. The ink pad 32 includes an ink impregnating layer 27 from which the ink is oozed out upon pressure.

The stencil sheet 1 drawn out of the supply roll 3 is transferred between the thermal head 7 and the platen 9 for forming dot perforations. The stencil sheet 1 is taken up by the takeup roll 5 by way of the guide rolls 15, 19.

Figure 8:
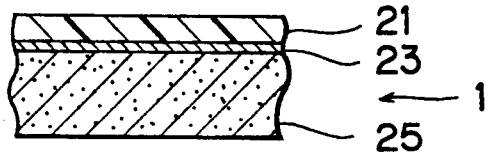
FIG. 8 is a cross-sectional view showing a stencil sheet used in this embodiment.
Figure 9:
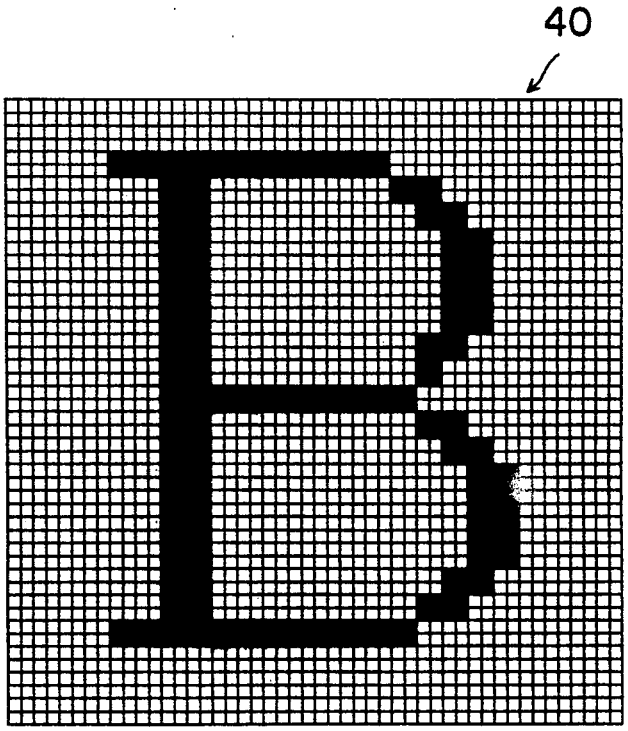
FIG. 9 is a view showing an original ON bit image to which perforation or ON bit control according to the present invention is to be effected.

As shown in FIG. 8, the stencil sheet 1 includes a thermoplastic film 21, an adhesive layer 23 and a porous support 25. The thermoplastic film 21 and the porous support 25 are bonded with each other by the adhesive layer 23. In the illustrated embodiment, the thermoplastic film 21 has a thickness of 2 μm and is formed of polyethylene terephthalate (hereinafter simply referred to as "PET"). However, a film of polypropylene or a copolymer of vinylidene chloride-vinyl chloride is also available.

The thickness of the PET film is preferably in a range of from 1 μm to 4 μm. If the thickness is less than 1 μm, production cost may be increased and resultant film does not provide sufficient strength. On the other hand, if the thickness is more than 4 μm, it would be impossible to form perforation by a general thermal head with a rate of 1mJ/dot.

The porous support 25 is formed of thin porous sheet mainly composed of a natural fiber such as manila hemp fiber, a paper mulberry (kozo and mitsumata), synthetic fiber such as polyethylene terephthalate, polyvinyl alcohol, and polyacrylonitrile, and a semi-synthetic fiber such as rayon. The stencil sheet 1 thus constructed is wound on the roll 3 in such a manner that the thermoplastic film 21 is positioned radially outwardly, so that the dot perforations can be formed in the film 21 when facing with the thermal head 7.

As shown in FIG. 7, the platen 9 is rotated in a direction indicated by an arrow A by a drive means (not shown). Because of the frictional force established between the platen 9 and the stencil sheet 1, the stencil sheet 1 is drawn out of the supply roll 3 and is fed in confronting relation to the thermal head 7. The heat generating elements of the thermal head 7 selectively heat and melt the surface of the thermoplastic film 21 of the stencil sheet 1 in accordance with an image information in synchronism with the rotation of the platen 9. Thus, a perforated image is formed in the thermoplastic film 21 of the stencil sheet 1.

The stencil sheet 1 formed with the perforated image is fed until an entire perforated image is completely brought into intimate contact with the ink application surface of the ink pad 32. While the perforated image region of the stencil sheet 1 is in intimate contact with the ink application surface of the ink pad 32, a pressure is applied so that the thermoplastic film 21 of the stencil sheet 1 is brought into intimate contact with a print sheet 33. The ink impregnated in the ink impregnating layer 27 within the ink pad 32 passes through the porous support 25 of the stencil sheet 1, and is oozed out through the perforated region. Thus, the ink is transferred onto the print sheet 33 for providing an inked image corresponding to the perforated image.

Further, the stencil sheet 1 which has been used for printing is wound over the takeup roll 5 urged in a direction indicated by an arrow B by virtue of takeup torque. The takeup torque is applied to the takeup roll 5 through a conventional slippage means.

Next, dot perforation control will be described with reference to FIGS. 9 through 17.

Figure 16:
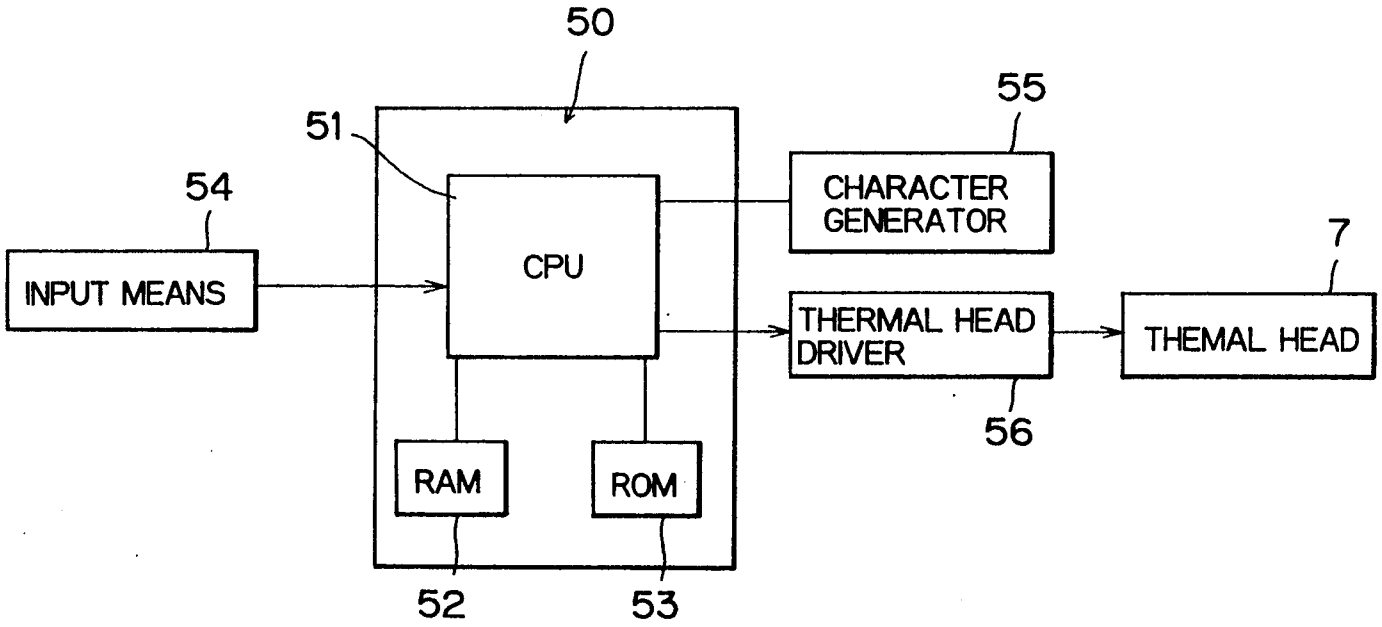
FIG. 16 is a block diagram showing a ON bit control according to the embodiment of this invention.
Figure 17:
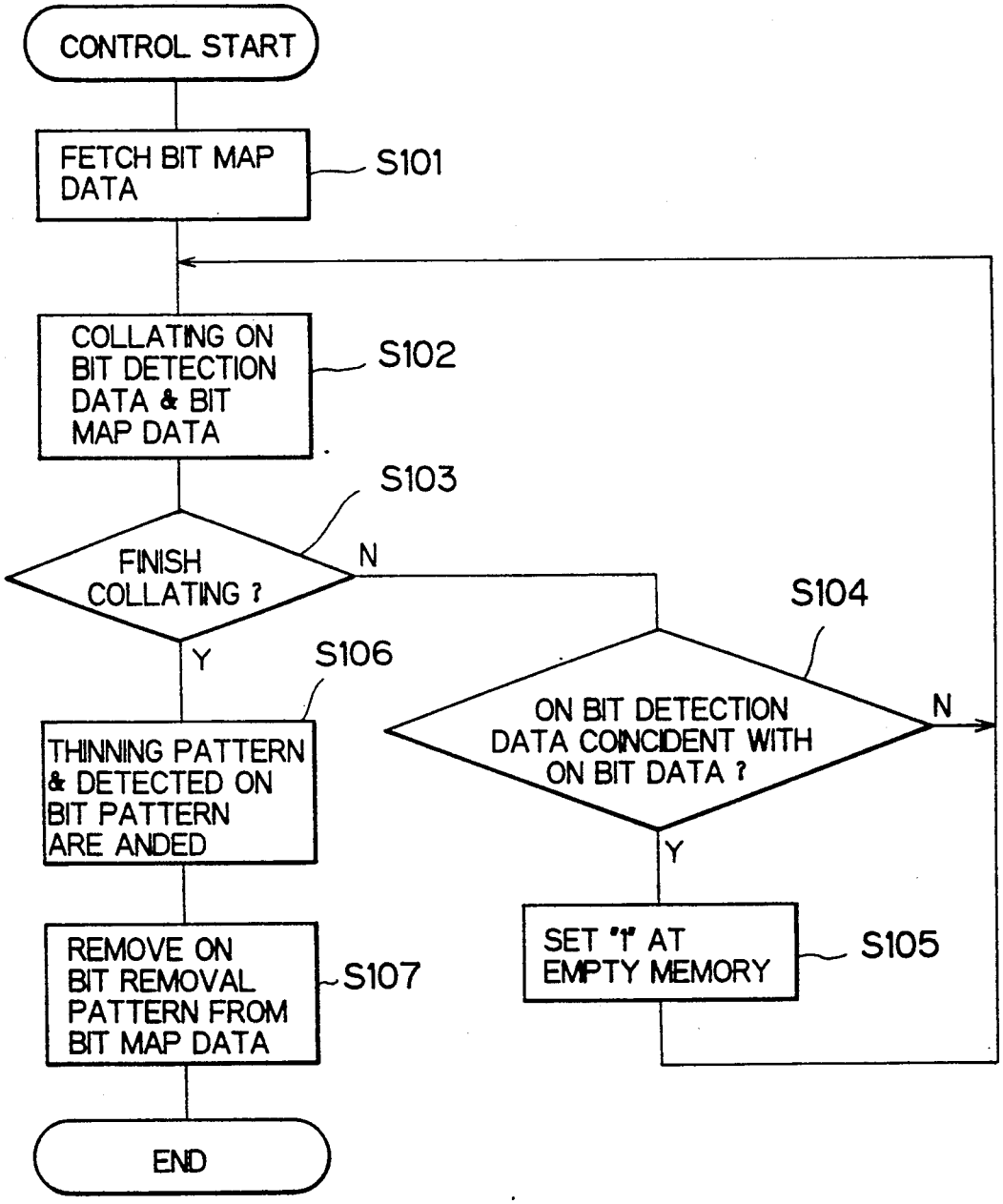
FIG. 17 is a flowchart showing the ON bit control routine according to the embodiment of this invention.

FIG. 16 shows an electronic control unit 50 including a CPU 51, a RAM 52 and a ROM 53. The RAM 52 and ROM 53 are connected to the CPU 51. Further, an input means 54 such as a keyboard of a personal computer is connected to the CPU 51. To the CPU 50, are connected to a character generator 55 and a thermal head driver 56 to which the thermal head 7 is connected.

Figure 10:
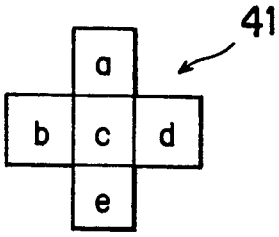
FIG. 10 is a view showing a pattern for detecting densely formed perforated area.

The input means 54 is adapted for inputting data of desired character to be printed. The character generator 55 is adapted for providing a bit map data to the CPU in response to the input data to provide ON bit image data shown in FIG. 9. The RAM 52 is adapted for successively storing therein the character data sent from the input means 54 through the CPU 51. The RAM 52 is also adapted for storing original ON bit image data (FIG. 9) provided by the bit map data. The RAM 52 also has an empty memory area whose size is equal to the size of the original ON bit image data. The ROM 53 is adapted to store ON bit detection pattern 41 as shown in FIG. 10 for detecting densely perforating area with respect to the original ON bit image data. The ROM 53 also stores therein a bit thinning pattern 43 shown in FIG. 12, Dot perforation control operation will be described with particular reference to a flowchart shown in FIG. 17. Character data generated by the input means 54 is inputted into the CPU 51, and the character data are successively stored in the RAM 52. If character inputting operation through the input means 54 is completed, and a start of the perforation control operation is instructed from the input means 54, the perforation control operation is started. in Step S101, the CPU 51 fetches the character data stored in the RAM 52 and sends the character data to the character generator 55. In accordance with the character data, bit map data is provided in the character generator 55 for forming the original ON bit image data (FIG. 9), and the original ON bit image data are stored in the RAM 52.

Then, in Step S102, each of the bits of the original ON bit image data 40 is subjected to collating by the ON bit detection pattern 41 shown in FIG. 10 stored in the ROM 53. In Step S103, judgment is made as to whether or not collating with respect to all bits of the original image data are finished. Since the collating is carried out with respect to each one of the bits of the original image data 40, the judgment falls No, and the routine goes into Step S104 where judgment is made as to whether or not all bits (a) through (e) of the detection pattern 41 are coincident with the perforating bits (ON bits) of the original image data 40. This judgment is made in such a manner that the center bit (c) of the detection pattern 41 is superposed with a specific bit of the original image data 40. If judgment falls No, that is, if the detection bit (c) is not superposed with the specific ON bit and/or if all the neighboring bit (a),(b),(d), (e) are not superposed with neighboring ON bits around the specific bit of the original image data, the routine returns back to the Step S102, and the same judgment is carried out with respect to the neighboring bit by shifting the center detection bit (c) onto the neighboring bit on the original image data.

Figure 11:
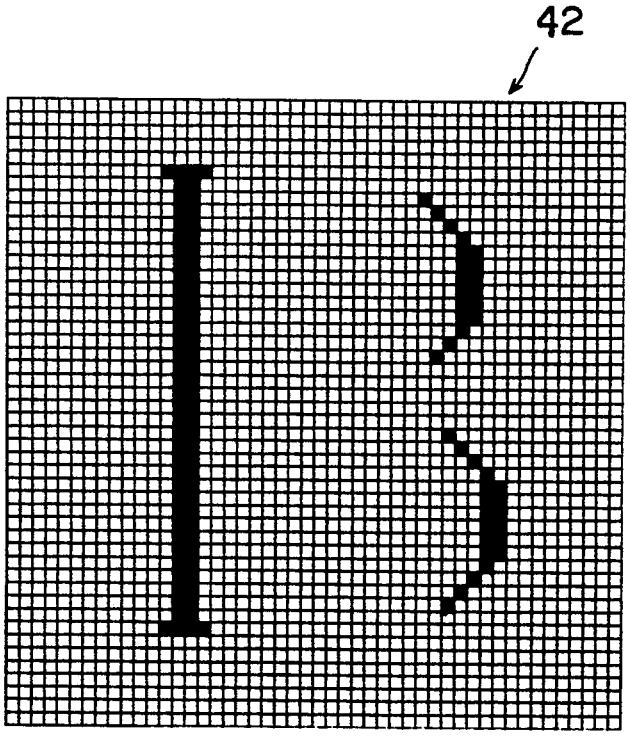
FIG. 11 is a view showing detected area.

On the other hand, if the judgment in the Step S104 falls Yes, that is, the detection bits (a) through (e) are all superposed with ON bits of the original image 40 in the event that the center detection bit (c) is superposed with the one specific ON bit, the routine proceeds into Step S105 where the specific ON bit position is stored by setting "1" in the empty memory region of the RAM 52. The Steps S102 through S105 are repeatedly carried out until all bits of the original image data 42 are subjected to the collating or detection. As a result, a detected ON bits area is obtained as shown in FIG. 11. This image 42 corresponds to dense perforation area.

Figure 12:
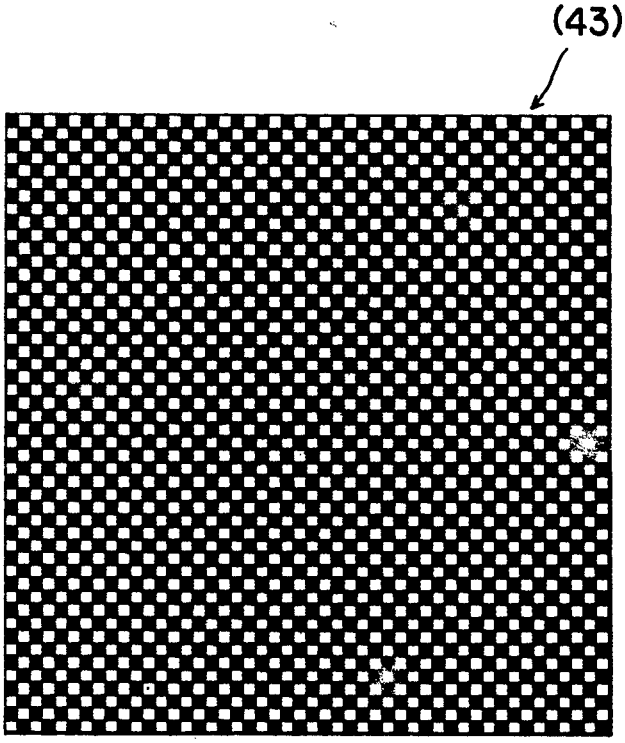
FIG. 12 is a view showing a thinning pattern with respect to the densely formed perforated image.
Figure 13:
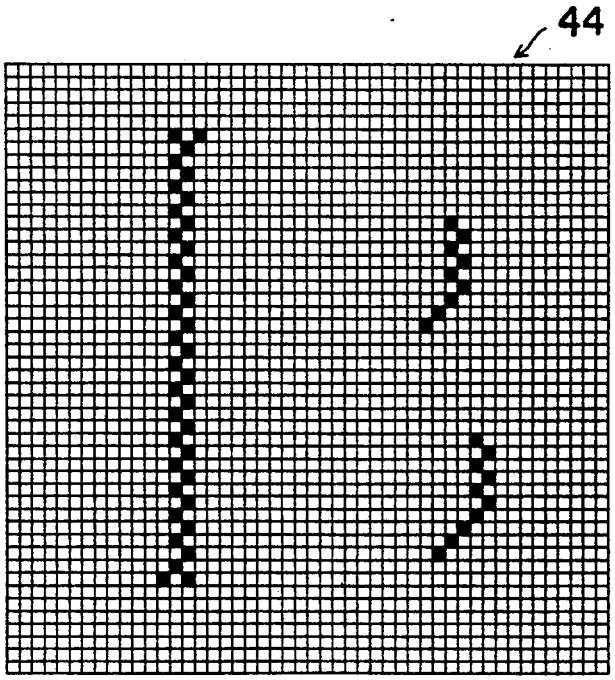
FIG. 13 is a view showing a OFF bit pattern at the densely formed perforated area.

Thus, in the step S103, the judgment falls Yes, and the routine proceeds into Step S106 where bit thinning pattern as shown in FIG. 12 stored in the ROM 53 is fetched, and the thinning pattern 43 is superposed with the detected ON bits area shown in FIG. 11. The thinning pattern 43 and the detected ON bits pattern 42 are ANDed together so as to obtain ON bit removal pattern 44 as shown in FIG. 13.

Figure 14:
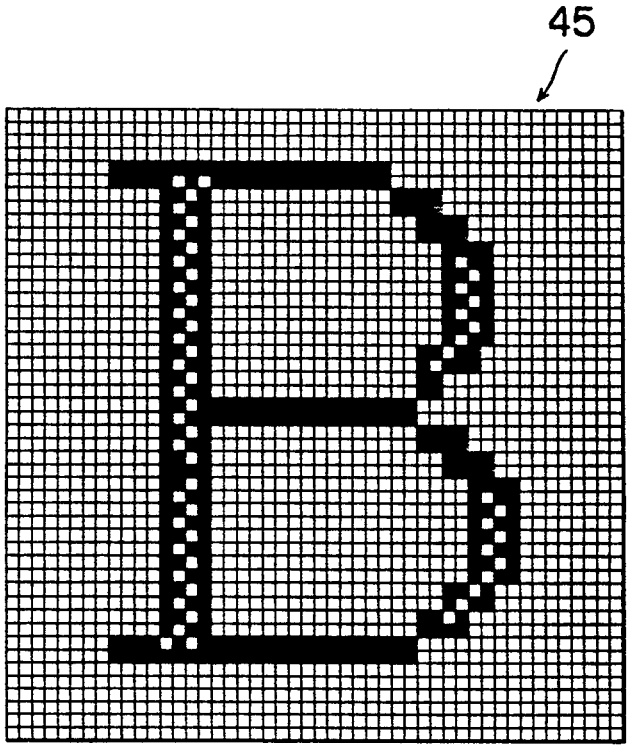
FIG. 14 is a view showing a final perforated pattern or final ON bit pattern with respect to the original image according to the embodiment of this invention.

Then, in Step S107, the ON bit removal pattern 44 is removed from the original ON bits pattern 40, to thereby provide a final ON bit pattern as shown in FIG. 14. Thus, the control is ended. The final ON bit pattern data are transmitted to the thermal head driver 56 for selectively operating the heat generating elements of the thermal head 7.

Figure 1:
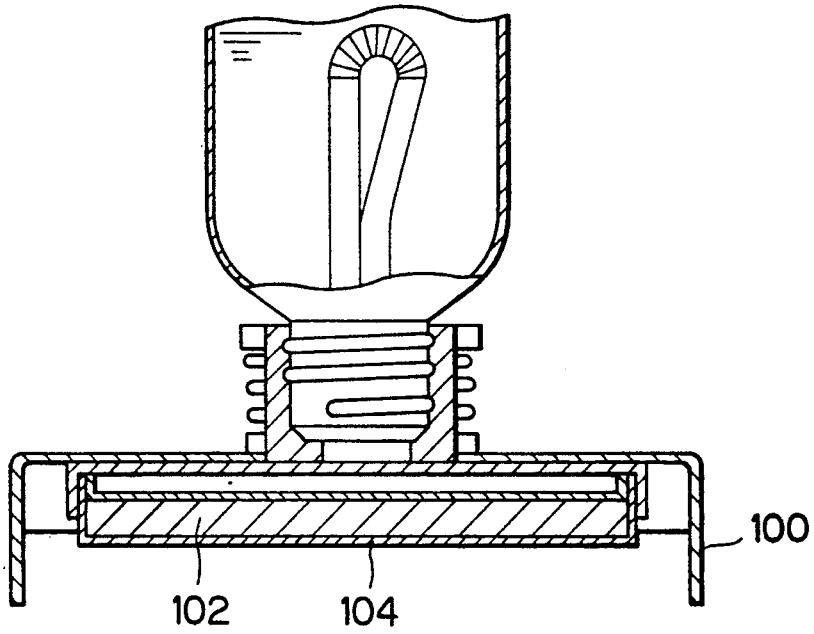
FIG. 1 Prior Art
FIG. 1 is a cross-sectional view showing one example of a conventional stencil making device.
Figure 2:
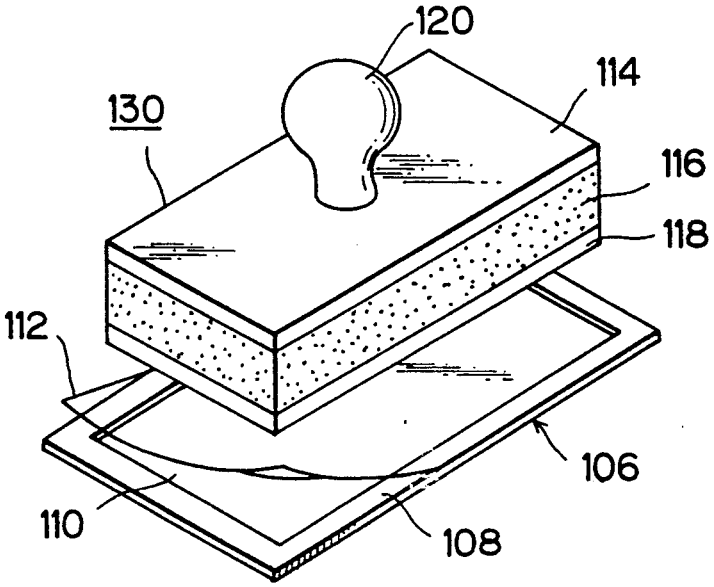
FIG. 2 Prior Art
FIG. 2 is a perspective view showing another example of a conventional stencil making device.
Figure 3:
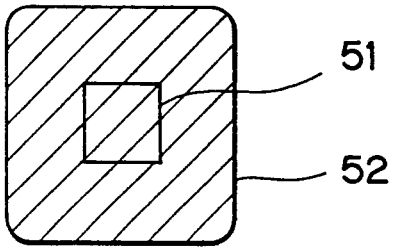
FIG. 3 Prior Art
FIG. 3 is a view for description of a perforation size and ink spreading area.
Figure 4:
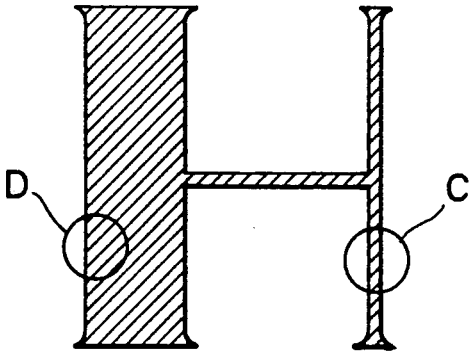
FIG. 4 Prior Art
FIG. 4 is a view for description of a shadow character in which thick and thin character portions D and C are delineated.
Figure 5A:
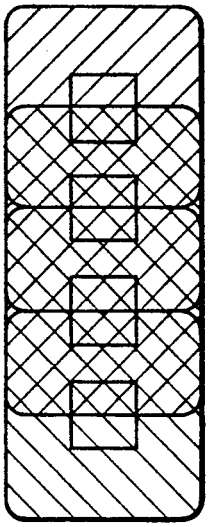
FIG. 5(a) Prior Art
FIGS. 5(*a*) and 5(*b*) are views showing printing results according to the conventional stencil making device at portions corresponding to the portion C and portion D of FIG. 4, respectively.
Figure 5B:
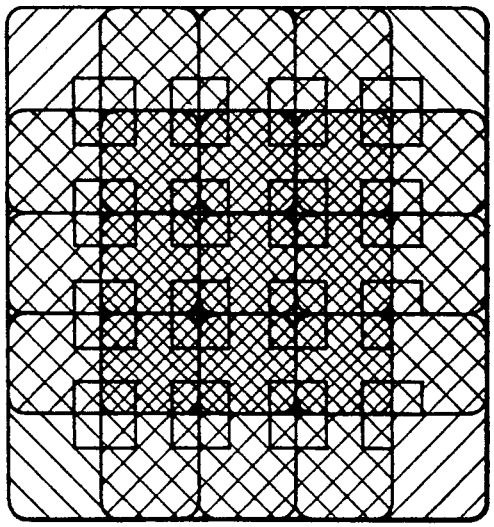
FIG. 5(b) Prior Art
Figure 15:
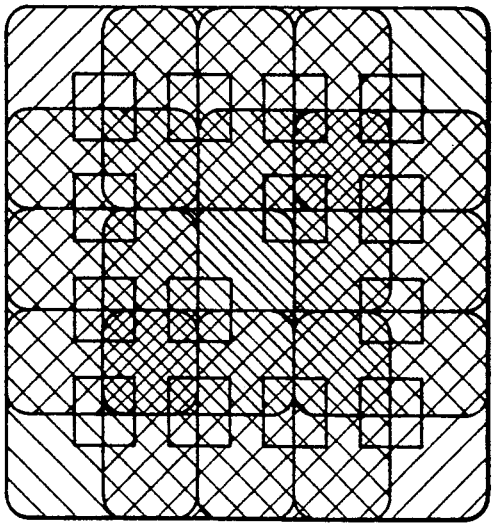
FIG. 15 is a view showing a printing result according to the embodiment of this invention.

Thus, according to the present invention, since the ON dot area is reduced at the dense dot portion, ink overlap can be avoidable. For example, as shown in FIG. 15, if a portion D shown in FIG. 4 of a shadow character H is to be perforated by 4×4 ON dot patterns, there are 4 (four) single inked portion, 13 (thirteen) double piled ink portions, 6 (six) three piled ink portions, and 2 (two) fourpiled ink portions. Thus, ink overlap can be greatly reduced.

Figures 18, 19:
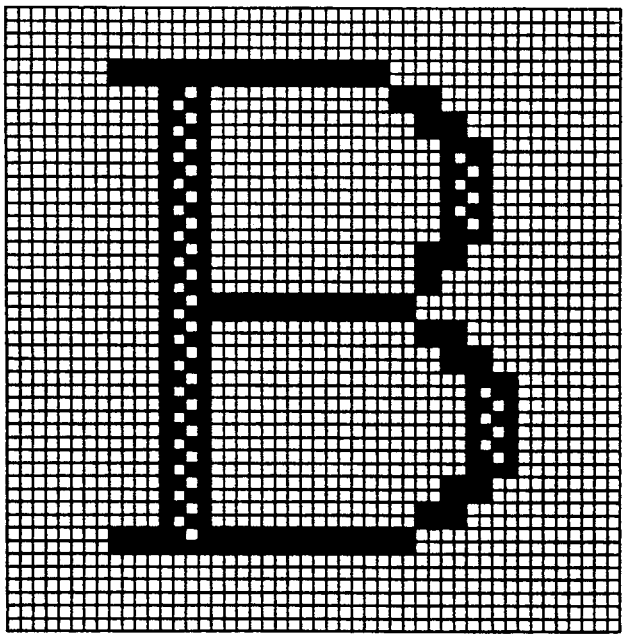
FIG. 18 is a view showing another ON bit detection pattern for detecting densely formed perforated area according to a modified example.
FIG. 19 is a view showing a final perforated pattern with respect to the original image according to the modified example of this invention.

FIG. 18 shows another detection bit pattern for detecting densely formed ON bit area. The ON bit detecting pattern has nine detection bits, and a center detection bit (e) corresponds to the center detection bit (c) shown in FIG. 10. Accordingly, a final ON bit pattern shown in FIG. 19 can be obtained with respect to the character B.

As is apparent from the foregoing description, in the stencil making device according to the present invention, numbers of dots to be perforated is changed depending on crowdedness of the ON dot regions. That is, by using ON bit detection pattern, ON bit data are converted to OFF bit data at a portion where ON bits are densely distributed. Therefore, it is possible to reduce the formation of the perforations at the crowded dot area so as to prevent the large volume of ink from being transferred from the ink pad to the print sheet. Accordingly image can be dried at an early stage, and high quality printing results without any contamination to hand and other region of the print sheet.

While the invention has been described in detail and with reference to specific embodiments thereof, it would be apparent to those skilled in the art that various changes and modifications may be made therein without departing from the spirit and scope of the invention.

What is claimed is:

1. A stencil making device for transferring an ink through a perforated image formed in a heat sensitive stencil sheet to form an inked image corresponding to the perforated image on a print sheet, the heat sensitive stencil sheet being formed of a thermoplastic film and a porous support bonded thereto, the stencil making device comprising:

feeding means for feeding the heat sensitive stencil sheet;

a thermal head which includes a plurality of heat generating dots, each having an ON and OFF dot portion, where ON indicates heat is being generated at the ON dot portion and OFF indicates a lack of heat being generated at the OFF dot portion, said thermal head being used for forming perforations to form the perforated image on the thermoplastic film of the stencil sheet, the perforations being formed at the ON dot portions of the thermal head;

an input means for inputting character data into a control means;

a character generator for providing and sending a bit map data tot he control means in response to the character data;

control means for controlling numbers of perforations depending on crowdedness of the ON dot portions, the control means comprising:

means for storing the bit map data inputted from the character generator, the bit map data being indicative of ON bits region and OFF bits region;

means for converting densely congregated ON bits region among the bit map data into OFF bits region;

means for providing a final ON bits region by removing the OFF bit region from the ON bit region of the bit map data, the final ON bit region providing the ON dot portions of the thermal head; and means for transmitting the final ON bits region to the thermal head.

2. The stencil making device as claimed in claim 1, wherein the converting means comprises:

means for storing ON bit detection pattern, the ON bit detection pattern including a center detection bit and neighboring detection bits around the center detection bit;

means for superposing the ON bit detection pattern with the bit map data in such a manner that the center detection bit is superposed with a specific bit of the bit map data; and means for setting OFF bit data at a position corresponding to the specific bit, if all bits of the ON bit detection pattern are superposed with ON bits of the bit map data, the latter ON bits being positioned around the specific bit.

3. The stencil making device as claimed in claim 2, wherein the converting means further comprises:

means for storing an ON bit thinning pattern; and means for ANDing the ON bit thinning pattern and the ON bit detection pattern to obtain an ON bit removal pattern.

4. A stencil making device for transferring an ink through a perforated image formed in a heat sensitive stencil sheet to form an inked image corresponding to the perforated image on a print sheet, the stencil making device comprising:

feeding means for feeding the stencil sheet;

a thermal head comprising a plurality of heat generating dots, each having an ON and OFF dot portion, where ON indicates heat is being generated at the ON dot portion and OFF indicates a lack of heat being generated at the OFF dot portion, said thermal head being used for forming perforations to form the perforated image on the stencil sheet, the perforations being formed at the ON dot portions of the thermal head;

detection means for detecting densely distributed ON dot portions; and control means for reducing numbers of perforations at a portion where the ON dot portions are densely distributed as a result of a detection by the detection means.

5. The stencil making device as claimed in claim 4, further comprising:

an input means for inputting character data into the control means; and a character generator for providing and sending a bit map data to the control means in response to the character data.

6. The stencil making device as claimed in claim 5, wherein the control means comprises:

means for storing the bit map data inputted from the character generator, the bit map data being indicative of ON bits region and OFF bits region;

means for converting densely congregated ON bits region among the bit map data into OFF bits region;

means for providing a final ON bits region by removing the OFF bit region from the ON bit region of the bit map data, the final ON bit region providing the ON dot portions of the thermal head; and means for transmitting the final ON bits region to the thermal head.

7. The stencil making device as claimed in claim 6, wherein the converting means comprises:

means for storing ON bit detection pattern, the ON bit detection pattern including a center detection bit and neighboring detection bits around the center detection bit;

means for superposing the ON bit detection pattern with the bit map data in such a manner that the center detection bit is superposed with a specific bit of the bit map data; and means for setting OFF bit data at a position corresponding to the specific bit, if all bits of the ON bit detection pattern are superposed with ON bits of the bit map data, the latter ON bits being positioned around the specific bit.

8. The stencil making device as claimed in claim 7, wherein the converting means further comprises:

means for storing an ON bit thinning pattern; and means for ANDing the ON bit thinning pattern and the ON bit detection pattern to obtain an ON bit removal pattern.

9. A method for forming a perforated image in a heat sensitive stencil sheet to form an ink image corresponding to the perforated image on a print sheet, the method comprising the steps of:

inputting character data into a control means;

providing and sending bit map data to the control means in response to the character data, the bit map data being indicative of ON bits region and OFF bits region, a combination of the ON bit region corresponding to a character of the inputted character data;

detecting a densely congregated ON bits region among the bit map data;

converting the densely congregated ON bits region into OFF bits map data;

providing a final ON bits region by removing the OFF bit region from the ON bit region of the bit map data, the final ON bit region providing the ON dot portions of a thermal head; and transmitting the final ON bits region to the thermal head.

10. The method as claimed in claim 9, wherein the converging step comprises the steps of:

storing an ON bit thinning pattern;

storing ON bit detection pattern, the ON bit detection pattern including a center detection bit and neighboring detection bits around the center detection bit;

superposing the ON bit detection pattern with the bit map data in such a manner that the center detection bit is superposed with a specific bit of the bit map data;

setting OFF bit data at a position corresponding to the specific bit if all bits of the ON bit detection pattern are superposed with ON bits of the bit map data, the latter ON bits being positioned around the specific bit; and ANDing the ON bit thinning pattern and the OFF bit data for reducing the ON bit region.

* * * * *